United States Patent [19]

Morrison

[11] 4,425,797

[45] Jan. 17, 1984

[54] STRENGTH TESTING GAME SYSTEM USING A CAN

[75] Inventor: David J. Morrison, Pensacola, Fla.

[73] Assignee: Crusher Corporation, Richmond, Va.

[21] Appl. No.: 272,730

[22] Filed: Jun. 11, 1981

[51] Int. Cl.[3] ..... G01L 5/02

[52] U.S. Cl. ..... 73/379; 73/821; 272/67

[58] Field of Search ..... 73/379, 380, 381, 821, 73/862.53; 100/902, 99; 272/67, DIG. 7

[56] References Cited

U.S. PATENT DOCUMENTS

| | | | |
|---|---|---|---|
| Re. 30,298 | 6/1980 | Keller | 100/99 X |
| 1,985,598 | 12/1934 | Carver | 100/99 |
| 2,330,492 | 9/1943 | Jansen | 73/381 |
| 2,645,936 | 7/1953 | Albrecht | 73/821 |
| 2,920,554 | 1/1960 | Bunke | 100/902 X |
| 3,005,153 | 10/1961 | Berkley et al. | 100/99 X |
| 3,019,019 | 1/1962 | Forte | 272/67 |
| 3,059,476 | 10/1962 | Spradlin | 272/DIG. 7 X |
| 3,464,260 | 9/1969 | Heyman | 73/821 X |
| 3,563,542 | 2/1971 | Wellmow et al. | 73/380 X |
| 3,593,573 | 7/1971 | Ely | 73/821 X |
| 3,929,331 | 12/1975 | Beeding | 73/379 X |
| 3,953,026 | 4/1970 | Stokely | 272/142 X |
| 3,982,757 | 9/1976 | McDonnell | 73/381 X |
| 4,116,050 | 9/1978 | Tanahashi et al. | 100/99 X |
| 4,209,167 | 6/1980 | Jansen | 73/380 X |
| 4,246,777 | 1/1981 | Birner et al. | 73/821 X |
| 4,323,237 | 4/1982 | Jungerwirth | 73/379 X |
| 4,333,396 | 6/1982 | Longnecker | 100/902 X |
| 4,343,465 | 8/1982 | Allen | 73/381 X |
| 4,345,520 | 8/1982 | Goldsmith et al. | 100/902 X |

OTHER PUBLICATIONS

"Rally" Electronic Exercise System with Four Adaptor Grips in Athaletee Journal, vol. 60, No. 9, May 1980.

Servo-Controlled Exoskeleton Measures Muscle Forces from Control Engineering, p. 92 from Cornell Aeronautical Lab., Buffalo, N.Y., The Myotron.

*Primary Examiner*—Charles A. Ruehl

*Attorney, Agent, or Firm*—C. Emmett Pugh & Associates

[57] ABSTRACT

A wrist or arm wrestling-type game system wherein the player tests or measures his strength by crushing one, two, or more cans, for example aluminum, beer-type cans within a measured time period. The can (or cans) to be crushed is (are) set upon a platform incorporated in the body of the strength testing game device. The player then inserts a coin in a slot (if the device is designed to be coin operated). places his elbow upon a resting pad, grasps a handle and pulls the handle down to drive a mechanical (or hydraulic) system to crush the cans. The handle pulls a cable which is run through a series of pulleys and which is attached (in a first embodiment) to a strongback. The strongback crushes the can against the platform. One of the pulleys through which the cable has been run can be attached to a spring pressure cylinder which measures the force exerted by the player when crushing the can. The placement of the player's elbow upon the elbow pad activates a start switch which in turn activates a timer. The force required to crush the can(s) together with the time required to crush the can are preferrably displayed in the strength testing game system. The strength testing game device is portable, can be placed upon any essentially horizontal surface, for example a bar, and can be secured to the horizontal surface.

16 Claims, 8 Drawing Figures

STRENGTH TESTING GAME SYSTEM USING A CAN

BACKGROUND OF THE INVENTION

1. Field of the Invention

This invention relates to a strength testing or measuring game system and in particular to a strength testing or measuring game device wherein the operator tests his/her strength by crushing a can, for example an aluminum, beer-type can. The strength testing game device of this invention preferrably displays the force exerted and the time required by the player to crush the can, thereby allowing comparison with other players, and is preferrably coin operated.

2. Prior Art

The manual art of hand or arm wrestling is well known and established between individuals as a means of testing or comparing one's strength to another.

Indeed, the present invention has as an object to provide a device or system which can be used instead of such a manual, direct, physical confrontation, and in fact the present invention allows the individual to "meet a challenge" without the challenger or even anyone else being present and to do so with a relatively small, portable device.

It has been suggested before to have an arm wrestling type device using a mannequin-type figure as the opponent or at least using a facsimile of an arm. None of these relatively large and cumberson mid-way or carnival-type items are involved with a can crushing mechanism but usually use springs, etc.

Can crushers (which usually are driven by motors and which treat the cans in bulk) are known presumably in the trash disposal or reclamation art, but such is not considered the art to which the present invention pertains.

SUMMARY DISCUSSION OF THE INVENTION

It is therefore an object of the present invention to provide a strength testing or measuring game device or system in which the player tests or measures his strength by crushing a can, for example an aluminum, beer-type can.

It is another object of the present invention to provide a means of indicating to the player and others the amount of force exerted to crush the beer can (and/or work, that is the force over the distance involved).

It is still another object of the present invention to provide a means to indicate to the player the time (and/or total power, that is force over the distance, with time) required to crush the can.

It is still another object of the present invention to provide a strength testing or measuring game device based on the crushing of a can which can be coin operated.

It is still another object of the present invention to provide a strength testing game device based on the crushing of a can which is portable and which can be mounted on a horizontal surface, such as for example on a bar.

An advantage produced by the use of the invention is that the user or the proprietor of the establishment in which the device is used ends up with crushed cans which may be more easily disposed of and/or re-cycled.

BRIEF DESCRIPTION OF THE DRAWINGS

Other objects and advantages of the present invention and a fuller understanding thereof may be had by referring to the following detailed description and claims taken together with the accompanying drawings, briefly described below, in which like parts are given like reference numerals and wherein:

FIG. 1 is a front, perspective view of a first embodiment of the present invention showing its overall configuration; while

FIG. 4 is a front, perspective view of a second, exemplary embodiment having two elbow pads or areas (left and right) with the can crushing stations being placed on opposite sides of the device; while

DETAILED DESCRIPTION OF THE PREFERRED EMBODIMENTS

Figure 1:
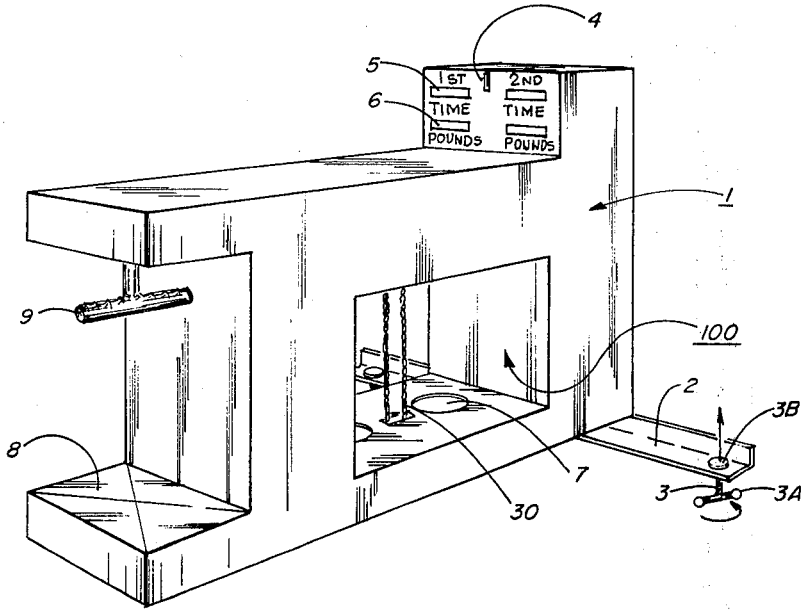

An orthographic projection of a first embodiment of the strength testing game device or system of the present invention is shown in FIG. 1, wherein there is depicted the overall configuration of the device.

A body 1 houses and serves as a frame for the internal working mechanism of the device. It may be set upon any horizontal surface large enough to support the device, such as for example a bar. The strength testing game device is secured in position by a clamp 2 which is fixed to the horizontal surface by a securing device 3, for example a threaded piece of stock fitted with a T-handle 3A for turning the threaded stock and a bearing plate 3B which secures against the bottom side of the horizontal surface upon which the body 1 has been set.

The body or frame 1 contains a central, longitudinally extending opening 100 into which is set the cans which are to be crushed. The cans sit up-right upon bases or platforms 7 and are crushed by a strongback 40 (note FIGS. 2 & 3) which is brought down as a can crushing head upon the tops of the cans by the cable 30. The cable 30 is ultimately attached to a moveable handle 9 which has a rigid portion shaped like an inverted "T" and is grasped by the user after the user has placed his elbow upon the elbow rest in the elbow area 8.

The strength testing game device is activated by the insertion of a coin in slot 4. The time required for the user to crush the can is shown on the time display 5 and the force exerted by the user to crush the can is shown on the force display 6. The device can be designed for use by two or more competitive users with a like number of independent displays.

Figure 3:
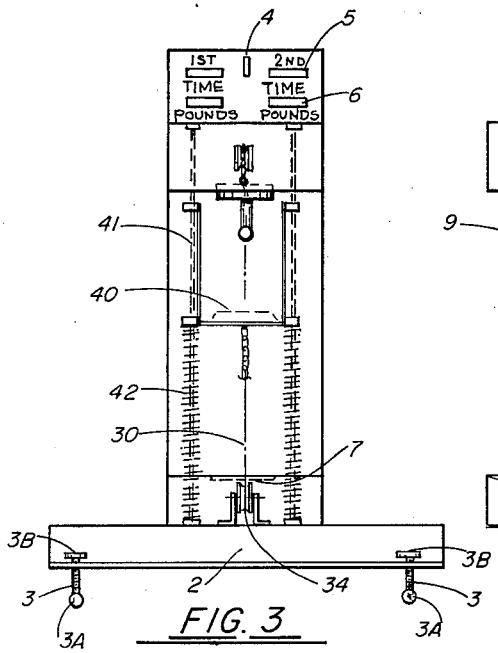
FIG. 3 is a front, cut-away view of the embodiment of FIG. 1 also showing its internal workings.
Figure 2:
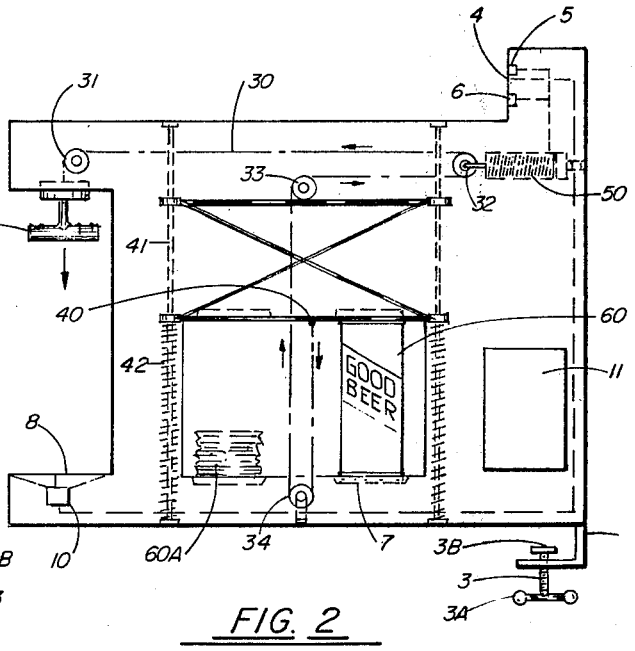
FIG. 2 is a side, cut-away view of the embodiment of FIG. 1 showing its internal workings.
Figure 4:
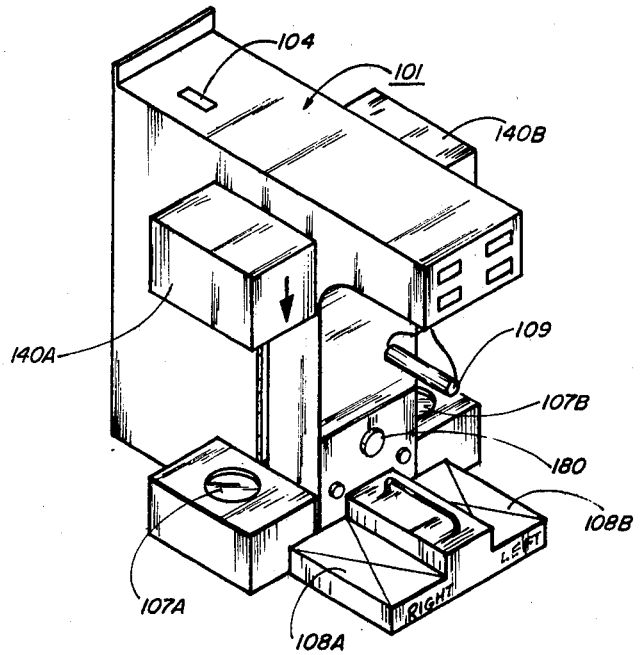

Referring to FIGS. 2 and 3 of the drawings, there is shown the internal force translating mechanism 70 of the strength testing game device. At least one can 60, for example a beer can, is set upon the platform 7 and a coin is inserted into the coin slot 4 and travels to the coin box 11, thereby activating the strength testing game device. (The details of the coin operated control mechanism are not shown and would be well known to those skilled in the vending art.)

The user places his elbow upon the elbow pad 8 and a pressure actuated, start switch 10 is activated which begins a timer 5. The user then grabs the T-handle 9 located above the elbow area 8 and pulls on the T-handle 9 downwardly and sidewardly to a lower position at a level comparable to that of the elbow area 8 and to its side to exert a force translated and applied by the device's internal mechanism 70 to crush the can 60 (note crushed can 60A). If desired the switch 10 could be wired so that the timer 5 is shut off should the user remove his/her elbow from the elbow area 8 and thus "cheat".

The force tension (note arrow heads of FIG. 2) placed upon the cable 30 travels from the T-handle 9 over guide wheel 31 to wheel 32 (which is attached to a spring pressure cylinder 50). The pulled cable 30 then travels over pulley 33 positioned above the can 60 down through pulley 34 at the base of the strength testing game device and upward to be attached to the strongback 40 positioned above the can(s) 60 to be crushed. The strongback 40 is mounted upon guide stays 41 and is held up by biasing springs 42.

As the handle 9 is pulled, cable 30 is placed in tension, thereby pulling the strongback head 40 downward to crush the can(s) 60 (note crushed can 60A) which is (are) sitting upon the base platforms(s) 7. The time being sensed and measured by appropriate meters (not illustrated) required by the user to crush the can(s) is shown in the time display 5, and the force (measured by spring pressure sensor cylinder 50) exerted by the user to crush the can is shown in the force display 6. A further display of force over distance (work) or work over time (power) could also be displayed if desired.

It is noted that the typical can that can be used in the device is made of aluminum and has a height of approximately five inches with a diameter of approximately two-and-one-half inches, such as for example a twelve ounce beer or soft drink can. It takes approximately one hundred and twenty pounds of force to crush such a can down against its vertical dimension. One can can be used when the user is smaller, while two cans can be used for the typical full size male. Thus, the number of can crushing stations, preferrably two, is used as a "built-in" user force variation adjustment.

Figure 8:
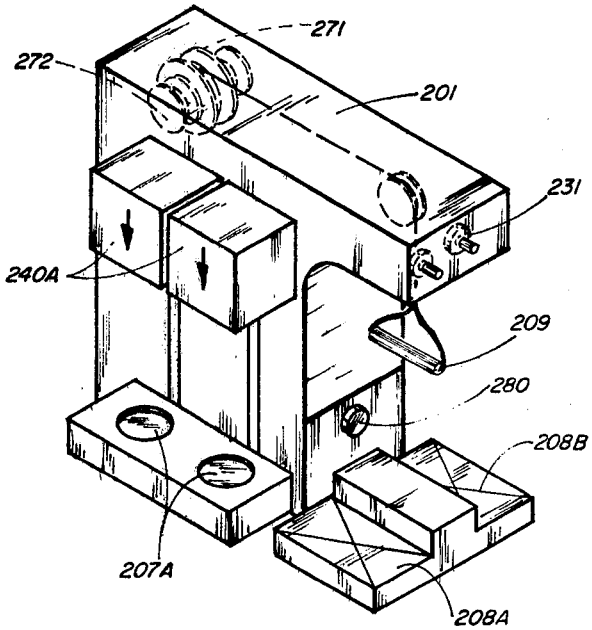
FIG. 8 is a front, perspective, "X-ray" view of a third, exemplary embodiment, also having two elbow pads (left and right) but with the can crushing stations being placed adjacent to one another on one side of the device.

Two further, alternate, exemplary embodiments of the invention are shown, one in FIGS. 4–7 and the other in FIG. 8.

In the second embodiment (FIGS. 4–7) the device includes its can crushing stations 107 (A & B) on opposite sides of its longitudinal center-line and has two, separate elbow stations 108A, B (right and left). The relative height of the elbow stations 108A, B can be adjusted upwardly or downwardly by loosening the locking, adjustment knob 180 to allow use by different size users.

Figure 6:
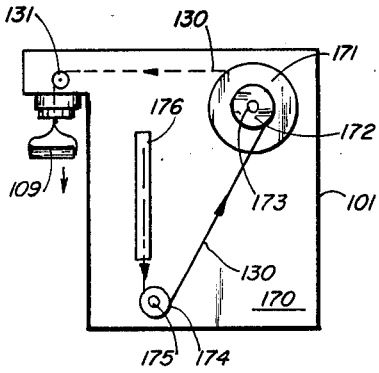
FIG. 6 is a side, partial, cut-away view of the embodiment of FIG. 4 also showing the internal pulley arrangements.
Figure 5:
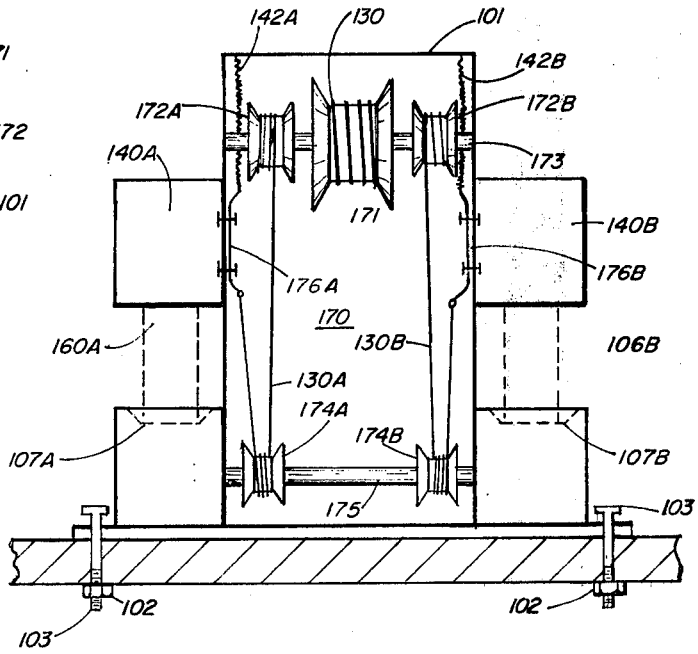
FIG. 5 is a front, cut-away view of the embodiment of FIG. 4 showing the internal pulley arrangements for mechanically increasing the force of the user on to the can crushing stations.

Again, after a coin is dropped in slot 104, the handle 109 is grasped and in arm wrestling fashion pulled down and to the side, pulling down and out cable 130 passing through opposed guides 131 (note FIG. 6).

An internal, force multiplying mechanical mechanism 170 (note FIGS. 5 & 6) then translates the force applied to the handle 109 and the movement of the cable 130 and applies it to the downwardly moveable crusher heads 140A, B. In order to multiply the force exerted on the handle 109, the cable 130 goes around and turns a large, centrally located pulley wheel 171 fixedly mounted on rotatable shaft 173, which in turn rotates the smaller pulley wheels 172A, B. By means of cables 130A, B extending down and around directional guides 174A, B, the upward movement of the cable 130A, B causes the can crusher heads 140A, B to be moved downwardly (note direction arrows of FIG. 7) by means of the fixed connections 176A, B. Thus, the downward and outward movement of handle 109 by the user causes the can crushing heads 140A, B to move downwardly with a greater force and at a slower rate. A force multiplying factor of five-to-one has been found suitable.

Figure 7:
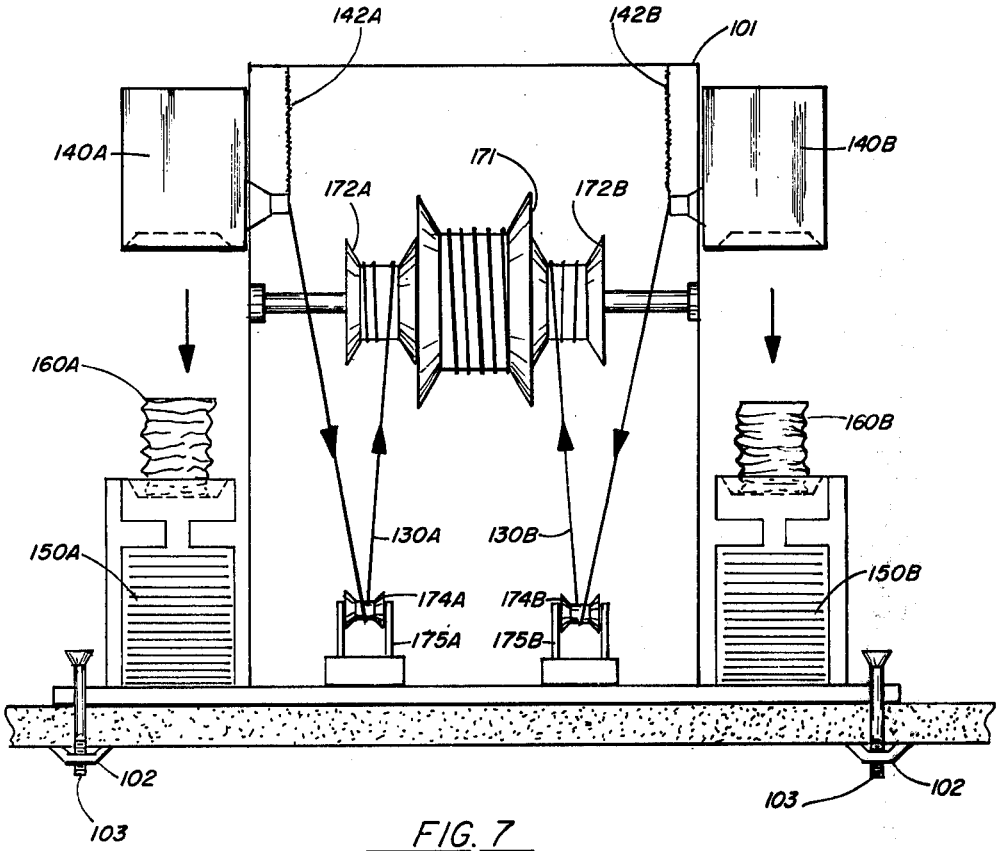
FIG. 7 is similar to FIG. 5 but shows the directions of movement and the lower scales measuring the forces being applied on the cans being crushed.

It is noted that the schematic, directional movement illustration of FIG. 7 also show some variations in pulley and shaft mounting structures. Also for brevity purposes and because many of the elements of the three embodiments (FIGS. 1, 4 & 8) are the same structurally and/or functionally, detailed descriptions of them are not repeated here. It is noted that like elements are given like reference numbers but with different numerical prefixes, and, if on different sides, the like elements within an embodiment are numbered the same but with "A" and "B" suffixes. Compare particularly for example B with 40, etc.

In the third embodiment (FIG. 8) the can crushing stations 207A, are again positioned side-by-side but on the same side of the longitudinal center-line of the device.

Of course the pulley systems illustrated are merely exemplary and are subject to many variations to achieve the desired can crushing force and movement rate desired or to achieve variability for different users. Alternatively, of course, hydraulic systems could be utilized in place of the mechanical pulley systems illustrated.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A strength testing system for allowing a person to test his/her arm strength, comprising:

a frame;

moveable handle means located on and attached to said frame for grasping and moving by the user;

an elbow area associated with said frame located below said handle means, the user putting his/her elbow in the elbow area and grasping said handle means when the system is in use, said handle means being moveable from an upper position down to a lower position at a level comparable to and to the side of the elbow area;

at least one can crusher station associated with said frame, each said can crushing station including a base area associated with it and against which a can is locatable and moveable, and can crushing head means moveable under force toward the base area for crushing a can positioned between it and the base area; and force application means associated with said frame for translating the movement of said handle means and the force exerted by the user on said handle means to said can crushing head means, causing it to move with force toward the base area against any can located between said can crushing head and the base area.

2. The system of claim 1, wherein there is further included in association with said frame, force measuring and associated display means for measuring and displaying the force exerted by the user on said handle means during use.

3. The system of either one of claims 1 or 2, wherein there is further included, in association with said frame, timer means for measuring, recording and displaying the amount of time involved in crushing a can.

4. The system of claim 3, wherein said timer means includes a pressure-sensitive, start switch positioned beneath said handle means and activated by the placement of the elbow of the user in the elbow area.

5. The system of claim 4, wherein said handle means comprises a handle having a rigid portion which at least in part has an inverted T-shape configuration.

6. The system of claim 2, wherein said force measuring means comprises a spring-pressure sensing cylinder anchored at one end to said frame and attached at the other end at least indirectly to said said head means.

7. The system of claim 1, wherein there is further included, in association with said frame, coin operated means for controlling the use of the system.

8. The system of claim 1, wherein said frame further includes securing means attached to it for securing it to an at least generally horizontal surface.

9. The system of claim 8, wherein said securing means is comprised of a rigid L-shaped clamp member protruding beyond the bottom of said frame, said L-shaped member being fitted with fastening devices comprised of threaded stock which is fitted with a T-handle for adjustment and a bearing surface for mating with the underside of the surface to which the frame is to be secured.

10. The system of claim 1, wherein said can crushing head means is comprised of a strongback positioned above the can to be crushed and attached by means of a cable to said handle.

11. The system of claim 10, wherein said strongback is mounted on vertical guides and held in a raised position above the base area by coiled springs through which said guides pass.

12. The system of claim 1, wherein said force application means includes force multiplying means for multiplying the amount of force exerted by the user in its translation to said can crushing head means.

13. The system of claim 12, wherein said force multiplying means comprises a series of different diameter pulley wheels.

14. The system of claim 1, wherein there is included at least two, spaced can crushing stations positioned side-by-side, the cans being positioned standing up in said can crushing stations.

15. The system of claim 1, wherein said moveable handle means is located at and suspended from an upper portion of said frame.

16. The method of testing the strength of a person, comprising the following steps:

(a) providing a device having
a frame;
moveable handle means located on and attached to said frame for grasping and moving by the user;
an elbow area associated with said frame located below said handle means, the user putting his/her elbow in the elbow area and grasping said handle means when the system is in use, said handle means being moveable from an upper position down to a lower position at a level comparable to and to the side of the elbow area;
at least one can crusher station associated with said frame, each said can crushing station including
a base area associated with it and against which a can is locatable and moveable, and
can crushing head means moveable under force toward the base area for crushing a can positioned between it and the base area; and
force application means associated with said frame for translating the movement of said handle means and the force exerted by the user on said handle means to said can crushing head means, causing it to move with force toward the base area against any can located between said can crushing head and the base area;

(b) placing an uncrushed can in said crushing station;

(c) the user putting his/her elbow in the elbow area and grasping said handle means and moving said handle means from said upper position down to said lower position at the level comparable to and to the side of the elbow area, crushing the can in said crushing station; and (d) registering directly or indirectly the force and/or power exerted by the user.

* * * * *